US006298858B1

(12) United States Patent
Coleman, III et al.

(10) Patent No.: US 6,298,858 B1
(45) Date of Patent: Oct. 9, 2001

(54) TOBACCO FLAVORING COMPONENTS OF ENHANCED AROMATIC CONTENT AND METHOD OF PROVIDING SAME

(75) Inventors: William Monroe Coleman, III; Thomas Albert Perfetti; Ronald Lewis Parks; Michael Francis Dube; Luis Mayan Dominguez, all of Winston-Salem, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 09/195,753

(22) Filed: Nov. 18, 1998

(51) Int. Cl.[7] ..... A24B 15/18

(52) U.S. Cl. ..... 131/290; 131/276; 131/278; 131/296

(58) Field of Search ..... 131/260, 291, 131/294, 295, 296, 278, 276

(56) References Cited

U.S. PATENT DOCUMENTS

| | | | | |
|---|---|---|---|---|
| 3,424,171 | | 1/1969 | Rooker . | |
| 3,478,015 | | 11/1969 | Onishi et al. . | |
| 3,828,798 | * | 8/1974 | Harper et al. . | |
| 4,040,431 | * | 8/1977 | Ashworth et al. . | |
| 4,150,677 | | 4/1979 | Osborne, Jr. et al. . | |
| 4,281,671 | | 8/1981 | Bynre et al. . | |
| 4,506,682 | | 3/1985 | Muller . | |
| 4,537,204 | | 8/1985 | Gaisch et al. . | |
| 4,566,468 | | 1/1986 | Sachleben et al. . | |
| 4,596,259 | | 6/1986 | White et al. . | |
| 4,605,016 | | 8/1986 | Soga et al. . | |
| 4,607,646 | | 8/1986 | Lilly, Jr. et al. . | |
| 4,708,151 | | 11/1987 | Shelar . | |
| 4,714,082 | | 12/1987 | Banerjee et al. . | |
| 4,744,375 | * | 5/1988 | Denier et al. | 131/309 |
| 4,756,318 | | 7/1988 | Clearman et al. . | |
| 4,760,854 | * | 8/1988 | Jewell et al. | 131/291 |
| 4,771,795 | | 9/1988 | White et al. . | |
| 4,793,365 | | 12/1988 | Sensabaugh, Jr. et al. . | |
| 4,862,905 | | 9/1989 | Green, Jr. et al. . | |
| 4,882,128 | | 11/1989 | Hukvari et al. . | |
| 4,941,484 | | 7/1990 | Clapp et al. . | |
| 4,986,286 | | 1/1991 | Roberts et al. . | |
| 5,016,654 | | 5/1991 | Bernasek et al. . | |
| 5,038,802 | | 8/1991 | White et al. . | |
| 5,060,669 | | 10/1991 | White et al. . | |
| 5,099,862 | | 3/1992 | White et al. . | |
| 5,121,757 | | 6/1992 | White . | |
| 5,131,415 | | 7/1992 | Munoz et al. . | |
| 5,159,942 | | 11/1992 | Brinkley et al. . | |
| 5,234,008 | | 8/1993 | Fagg . | |
| 5,235,992 | | 8/1993 | Sensabaugh, Jr. . | |
| 5,318,050 | | 6/1994 | Gonzalez-Parra et al. . | |
| 5,413,122 | | 5/1995 | Shu et al. . | |

FOREIGN PATENT DOCUMENTS

| | | |
|---|---|---|
| 1 517 280 | 9/1969 | (DE) . |
| 0 212 234 | 3/1987 | (EP) . |
| 0 277 519 | 10/1988 | (EP) . |
| 0 517 407 A2 | 12/1992 | (EP) . |
| 0 821 886 A2 | 2/1998 | (EP) . |
| 572236 | 9/1945 | (GB) . |
| 1 383 829 | 2/1975 | (GB) . |
| WO 97/04673 A1 | 2/1997 | (WO) . |

OTHER PUBLICATIONS

Aromatic or Drietal Tobaccs, Frederick A. Wolf, Duke University Press, Durham NC, 1962, p. 1 of Forward, 1962.*

*The Design of Cigarettes*, C. L. Browne, Hoechst Celanese Corporation, 1979, pp. 23 and 57–58.

* cited by examiner

*Primary Examiner*—James Derrington

(57) ABSTRACT

Improved flavorful and aromatic tobacco materials and a method for producing flavorful and aromatic components from all natural tobacco materials are provided. A first tobacco material is contacted with a second tobacco material to form a tobacco blend. The first tobacco material has a higher content of nitrogen source and a lower content of sugar source than the second tobacco material. The moisture content in the first and second materials of the tobacco blend is increased to at least about 20%. The tobacco blend having an increased moisture content is then subjected to heat treatment in a substantially atmospheric environment for a time and under conditions sufficient to generate flavorful and aromatic substances in said first and second tobacco materials.

30 Claims, No Drawings

TOBACCO FLAVORING COMPONENTS OF ENHANCED AROMATIC CONTENT AND METHOD OF PROVIDING SAME

FIELD OF THE INVENTION

The present invention relates to flavor and aroma substances for tobacco materials, and to methods for manufacturing same.

BACKGROUND OF THE INVENTION

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material. Many cigarettes include processed tobacco materials and/or tobacco extracts in order to provide certain flavorful characteristics to those cigarettes.

Flavor and aroma are important characteristics of smoking articles. To improve the flavor and aroma in smoking articles, flavorful and aromatic substances, including various natural extracts, have been included in smoking articles.

For example, U.S. Pat. No. 3,424,171 describes a process for the production of a non-tobacco smokable product having a tobacco taste. Tobacco is subjected to a moderate (i.e. below scorching) heat treatment i.e., at from about 175° to 200° C. (350° C. to 400° F.), to drive off aromatic components. These components are trapped on adsorbent charcoal, and removed from the charcoal by solvent extraction. The smokable product disclosed is vegetable matter, treated with the mixture of tobacco aromatic components and the solvent.

Similarly, U.S. Pat. No. 4,150,677 describes a process for the treatment of tobacco which comprises the steps of: (1) contacting tobacco which contains relatively high quantities of desirable flavorants with a stream of non-reactive gas, under conditions whereby the tobacco is heated in a temperature range from about 140° to 180° C.; (2) condensing the volatile constituents of the resulting gaseous stream; and (3) collecting said condensate. The condensate may be used subsequently to flavor a smoking material in order to enhance the organoleptic qualities of its smoke.

U.S. Pat. Nos. 5,038,802 to White et al. and 5,016,654 to Bernasek et al. disclose extraction processes which heat tobacco and then pass an inert atmosphere through the heating chamber to collect volatiles from the tobacco. The volatiles are then fractionated in downstream operations, which include liquid sorbents, cold temperature traps, and filters.

Flavorful and aromatic substances can also be produced from reactions of chemical materials in vitro or by adding chemicals to tobacco and reacting such added chemicals with endogenous compounds within tobacco materials.

For example, U.S. Pat. No. 3,478,015 to Onishi et al. discloses making aromatic materials by heating an amino acid and a sugar in the presence of a polyhydric alcohol. Similarly, U.S. Pat. No. 4,306,577 describes reacting reducing sugars and selected amino acids in the presence of ammonium hydroxide and optionally in the presence of an aldehyde. The flavorful materials produced can be incorporated into tobacco materials.

While these processes have produced flavor substances acceptable for use in many smoking articles, they have either been based on non-tobacco materials, or necessarily required the forming of a tobacco extract prior to the obtaining of the desired compound. Moreover, many of these processes required multiple steps of processing.

SUMMARY OF THE INVENTION

The present invention generally relates to natural tobacco flavoring substances useful in tobacco smoking products, and a method for providing flavorful and aromatic substances in tobacco materials.

The flavoring substances of this invention are prepared in situ by treatment of a tobacco blend w including a first tobacco material having a relatively high nitrogen source content and a relatively low sugar source content with a second tobacco material having a relatively low nitrogen source content and a relatively high sugar source content. The moisture content of the tobacco blend is adjusted to an amount of at least about 15% by weight, preferably at least about 20% by weight, more preferably from about 20% to about 40% by weight. The tobacco blend is then subjected to heat treatment under conditions sufficient to raise the temperature of the tobacco blend above about 250° F., preferably above about 260° F., more preferably above 270° F. As a result of this treatment, flavorful and aromatic substances are generated in the tobacco blend.

The flavorful and aromatic substances produced in the method of this invention are products of the Maillard reactions and comprise a complex mixture of volatile, semi-volatile, and non-volatile aroma/flavor components. The tobacco blend treated according to the invention and containing the flavorful and aromatic substances is typically subjected to a reordering treatment to increase its moisture content to the desired level of 10%–14% and then can be used directly in the manufacture of conventional cigarettes or other smoking articles without the need of any further flavorant additives or treatment.

In accord with the invention, the first and second tobacco materials are chosen such that the first tobacco material has a relatively high nitrogen source content and relatively low sugar source content as compared to the second tobacco material. This is achieved preferably by selection of the appropriate types of natural tobacco materials for the tobacco blend. In general, burley tobacco or another air dried tobacco which has a high nitrogen source content and a low sugar source content is used as the first tobacco material, while flue cured tobacco which has a high sugar source content and low nitrogen source content is suitable for the second tobacco material. Preferably, the tobacco materials in the blend are tobacco laminae or tobacco cut fillers, and can be used directly, after the process of this invention, in manufacturing of smoking articles such as cigarettes.

Typically, the moisture content of the tobacco blend is increased prior to heat treatment by intimately contacting the tobacco materials in the blend with water and allowing the water to be absorbed into the tobacco materials so that the resultant tobacco blend having an increased moisture content is substantially free of unabsorbed water. Optionally, flavorant additives (e.g., amino acids, amino acid analogs or amino acid sources or other nitrogen sources, and/or sugar or sugar sources) may be added, if desired, to the tobacco material prior to heat treatment. However, in preferred embodiments of the invention the tobacco blend is substantially free of exogenous, i.e., added sugar. Most preferably water which is substantially free of any additives is used to increase the moisture content of the tobacco materials in the tobacco blend, and the resultant tobacco blend which is subsequently subjected to heat treatment is substantially free of exogenous materials such as sugar or amino acids, or other chemicals.

The tobacco blend is subjected to the high temperature heat treatment for a time sufficient to alter the organoleptic characteristics (e.g., the flavor and aroma characteristics) of the blended tobacco material. Normally, the tobacco material is heated to a temperature above 250° F. preferably above 260° F. for a period of time sufficient to reduce the moisture content of the blended tobacco materials to below about 8% by weight, preferably about 6% by weight. Heating for a time period sufficient to achieve such reduction of the moisture content ensures that the tobacco blend temperature is sufficiently elevated to effect the desired increase in aroma/flavor compounds. It is preferable that the process of the invention is carried out so that the tobacco material is not exposed to such a high temperature for such a long period of time so as to provide an aroma/flavor which exhibits a burnt or tarry aroma/flavor. Accordingly, the blend is preferably subjected to heat treatment at a temperature between about 250° F. and 350° F. more preferably between about 260° F. and about 325° F.

Preferably, the tobacco blend of this invention is subjected to heat treatment in a substantially atmospheric environment, i.e., under ambient pressure. Typically, the tobacco blend normally is subjected to such treatment under conditions sufficient that the entire tobacco material is exposed to a temperature above about 250° F. for about 10 minutes. The resulting tobacco blend contains flavorful and aromatic substances and can be used as tobacco laminae or cut filler in smoking articles. Such substances comprises, e.g., pyrazines, Strecker aldehydes, and sugar thermal degradation products.

Since the flavorful and aromatic substances are generated directly in the tobacco materials which are used subsequently in manufacturing of smoking articles, no additional processing steps are required to flavor the tobacco. In addition, the conventional high temperature burley casing treatment and the use of casing additives such as sugar and the like can be minimized or eliminated because advantage is taken of the naturally occurring sugar source compounds present in high sugar source content tobaccos such as flue cured tobacco, to provide tobacco blends having flavor comparable to conventional blends of the cured tobacco with cased and heat treated burley tobacco. Thus, the present invention provides a simple and effective means to enhance the flavor and aroma of tobacco using all natural tobacco materials.

The foregoing and other advantages and features of the invention, and the manner in which the same are accomplished, will become more readily apparent upon consideration of the following detailed description of the invention taken in conjunction with the accompanying examples, which illustrate preferred and exemplary embodiments.

DETAILED DESCRIPTION OF THE INVENTION

The first tobacco material and the second tobacco material in the tobacco blend of this invention are chosen such that the first tobacco material has a relatively high nitrogen source content and a relatively low sugar source content as compared to the second tobacco material.

As used herein, the term "nitrogen source" means the nitrogen atom-containing chemical compounds in the tobacco materials used in the invention which either can directly react with sugars to generate aromatic and flavorful materials, e.g., by Maillard Reactions, or can be converted during the process of the invention to chemical compounds that are capable of reacting with sugars to form aromatic and flavorful materials, e.g., by Maillard Reactions. Typically the nitrogen source materials are water soluble. Water soluble ammonium, i.e., $NH_4^+$ in tobacco materials, for example, is the most preferred nitrogen source in the present invention.

As used herein, the term "sugar source" is intended to mean sugar compounds in the tobacco materials used in the present invention, which can be, e.g., reducing sugars such as glucose, fructose, lactose, or disaccharides, or polysaccharides. Typically, the sugar source in a tobacco material is the "total sugar," i.e., T sugar, which is well known in the art to be measurable by standard colormetric procedures or liquid chromatography methods.

Optionally, the tobacco blend can include more than one type of first tobacco material and more than one types of second tobacco material. Each first tobacco material should have a higher nitrogen source content and a lower sugar source content than each second tobacco material.

Various methods for determining the nitrogen source content and sugar source content in tobacco materials are known in the art. Preferably, the nitrogen source content in the first tobacco material is at least 10%, more preferably at least 20%, and most preferably at least 50% higher than that in the second tobacco material. Likewise, the sugar source content in the second tobacco material is preferably at least 10%, more preferably at least 20%, and most preferably at least 50% higher than that in the first tobacco material.

The tobacco materials useful herein can vary. Natural tobacco material, reconstituted tobacco material, or synthetic or semi-synthetic tobacco material can all be used for purpose of this invention provided that the above nitrogen and sugar source content requirements are met. However, in preferred embodiments of the invention, natural tobacco materials are typically used in the blend.

As well known in the art, different types of natural tobacco have different nitrogen and sugar source content partly due to different methods of cultivation and processing. For example, burley tobacco and Maryland tobacco generally have high nitrogen source contents and low sugar source contents. On the other hand, flue-cured tobacco and Turkish tobacco generally have low nitrogen and high sugar source contents. Thus, it is preferred that burley or Maryland tobacco is used as the first tobacco material and flue cured tobacco or Turkish tobacco as the second tobacco material in a tobacco blend of this invention.

Although not wishing to be bound by any theory, it is the inventors, belief that the flavorful and aromatic substances produced in accordance with the present invention is largely due to the Maillard reaction between the nitrogen source in the first tobacco material and the sugar source in the second tobacco material. Thus, the process of this invention makes use of the naturally existing reagents in tobacco materials without having to add any extraneous materials.

As is known in the art, growing practices, varieties, crop year, curing practices and growing locations are common factors that can alter the concentration of compounds, e.g., sugar and nitrogen source content, within a finished tobacco material. Therefore, selection of tobaccos containing varying amounts of naturally occurring sugars and nitrogen source can produce heat treated formulations with varying amounts of flavorful and aromatic substances, such as sugar/nitrogen reaction products.

Preferably, the first tobacco material has a water soluble ammonium content of at least about 0.2%, preferably at least about 0.4% of total weight. Preferably, the second tobacco material has a total sugar level at above about 10% by weight, more preferably at least about 15% by weight, as measured by standard colormetric procedures or liquid chromatography methods.

The ratio of first and second tobacco materials can vary, e.g., according to the nitrogen source content in the first tobacco material, or the sugar level in the second tobacco material. Generally speaking, a smaller amount is required of the first tobacco material, i.e., the high nitrogen source content tobacco, than the amount of the second tobacco, i.e., the lower nitrogen source content high sugar source content tobacco. In preferred embodiments, the first tobacco comprises from about 20 to about 50 weight percent of the blend and the second tobacco comprises about 80 to about 50% weight percent of the blend. However, the amount of each tobacco material can be varied depending on the nitrogen and sugar source content thereof. Thus, lower amounts of the first tobacco material can be used when the nitrogen source content is unusually high and similarly lower amounts of the second tobacco material can be used when the second tobacco material has an unusually high sugar source content. The optimum ratio of the two tobacco materials can be easily determined based on the nitrogen and sugar source contents, and by simple testing experiments as will be apparent to a skilled artisan apprised of the present invention.

The tobacco materials useful herein can be in various forms such as laminae, cut filler, shreds, strips, stems, leaves, or a dust or powder. Tobacco laminae, cut fillers and shreds are preferred which can be used, after heat treatment, directly in subsequent manufacturing of cigarettes.

It has been discovered that, in order to produce a satisfactory amount of flavorful and aromatic substances in the tobacco blend of this invention, the tobacco materials in the tobacco blend must possess certain moisture content, preferably more than 15% of the total weight, more preferably at least 20%, and most preferably from about 20% to about 40% by weight. Normally, the blend of the first and second tobacco materials is substantially solid, i.e., substantially free of any liquid that is in a separate phase. Thus the moisture content as indicated above refers to the content of the moisture that is absorbed in the tobacco materials.

The moisture content in the tobacco materials can be achieved by various methods. For example, an aqueous liquid, such as water, can be sprayed on, and subsequently absorbed by the tobacco materials. Alternatively, the tobacco materials can also be dipped into the liquid to absorb the desired amount of moisture. The moisture content can also be reached by spreading onto the tobacco materials casing solution or top dressing solution, or other liquids such as buffers, solvents, or solutions containing materials extraneous to natural tobacco materials. It is greatly preferred however that the tobacco materials of this invention are substantially free of non-tobacco extraneous materials, such as sugars, amino acids, or the like. Typically, the tobacco blend subjected to heat treatment contains less than 4%, preferably less than 1%, and more preferably zero percent of added sugar. In this manner, smoking articles made from all natural tobacco materials and substantially free of extraneous chemicals can be produced while still having satisfactory flavor and aromatic characteristics.

The moisture content of the tobacco materials in the tobacco blend may be adjusted either before or after the first tobacco material is brought in contact with the second tobacco material to form the tobacco blend.

The first tobacco material and the second tobacco material are in intimate contact with each other in the blend, preferably uniformly mixed in the tobacco blend. The methods of mixing or blending two or more different tobacco materials are well known in the art and should be apparent to a skilled artisan.

Once the moisture content in the tobacco materials is brought up to a desired level and the tobacco materials are in contact with each other, the blend may be left in storage for a period of time without heat treatment. However, as the moisture content can be high enough to allow microorganisms to grow slowly in the blend, it is not desirable to leave the moist blend for too long a time before subjecting it to heat treatment. In addition, it has been found that better results, i.e., more flavorful substances, can be obtained when the moist blend is subjected to heat treatment relatively quickly after adjustment of the moisture content to the desired elevated level. Thus, the time period during which the moist tobacco materials are in contact with each other without heat treatment is preferably less than 24 hours, more preferably less than 4 hours, and most preferably about 1 hour.

If desired, in addition to the first and second tobacco materials, the tobacco blend of this invention may further include other components. For example, additives can be added to the tobacco blend prior to heat treatment. Examples of such additives include, but are not limited to, amino acids (e.g., serine, threonine glutamine, asparagine, proline, alanine, cystine, aspartic acid, phenylalanine, glutamic acid, etc.), amino acid analogs or amino acid sources, one or more sugars or sugar sources (e.g., fructose, sucrose, glucose, maltose, etc.), and the like. If desired, flavoring agents (e.g., cocoa, licorice, St. John's bread, spices, herbs, and the like) can also be added to the tobacco blend. However, as described above, it is most preferable that the tobacco blend is substantially free of any materials extraneous to natural tobacco materials.

The tobacco blend having an increased moisture content is subsequently subjected to the high temperature treatment. Typically, such treatment involves heating the tobacco blend to a temperature more preferably above about 270° F. However, it is desirable to maintain the temperature of the tobacco material to a temperature below about 350° F., more desirably below about 320° F,. and most preferably at a temperature of about 280° F., in order to avoid damage to the structure of the tobacco laminae or cut fillers or shreds and to prevent an undesirable formation of components which are deleterious to the taste characteristics of the tobacco materials.

Although the moderately high temperature treatment can be performed in an inert pressure controlled environment, it is more preferably conducted conveniently under an ambient atmosphere, i.e., in a substantially atmospheric environment (i.e., air). This obviates the need for equipments such as sealed pressure vessels. The steps of introducing inert gases and pressurizing are therefore also avoided.

The amount of time that the tobacco material is subjected to the moderately high temperature treatment can be varied depending on factors such as the particular heat treating temperature, and the particular type and form of tobacco subjected to heat treatment. In general it is desirable to control the time/temperature profile of the heat treatment of the tobacco materials to achieve significant conversion of sugars and sugar amine intermediates of tobacco to Maillard Reaction products, while avoiding excessive heat treatment sufficient to generate significant quantities of materials exhibiting a burnt or tarry aroma and/or taste. Typically, the heat treatment should be conducted sufficient to heat the entire tobacco material at the desired temperature for a period that is sufficient to reduce the moisture content in the tobacco blend to below about 8% by weight, preferably to about 6% by weight. Generally speaking, the tobacco preferably is treated at about 260° F. to about 280° F. for about less than one hour, preferably less than 30 minutes, most preferably between about 5 minutes and about 20 minutes. Some minor degree of experimentation may be required to determine the optimum time of heat treatment, this being well within the capability of one skilled in the art once apprised of the present disclosure.

Conditions provided during the process of the present invention most desirably are such that the nitrogen source in the first tobacco material and the sugar source content in the second tobacco material undergo the Maillard Reactions. Although not wishing to be bound by any theory, the Maillard Reactions or "browning reactions" are reactions between (i) the amino substituents of amino acids, peptides, proteins or other nitrogen-containing compounds, and (ii) the carbonyl group of a sugar in the reducing form or other carboxyl-containing compounds in the tobacco material. Such reactions result in a significant darkening of the tobacco material, typically to an extremely dark brown color. See, Maillard, *Ana. Chim.,* Vol. 9, pp. 5 and 258 (1916); Hodge, *J. Agric. Food Chem.,* Vol. 1, p. 928 (1953); Nursten, *Food Chem.,* Vol. 6, p. 263 (1981) and Waller et al, *ACS Symp. Ser.* (1983).

Normally, the treated tobacco blend is storage stable. However, preferably the tobacco blend is subjected to a reordering treatment relatively quickly after treatment to increase the moisture content to between about 10 and 14 wt %. The treated and reordered tobacco blend can be employed immediately for use in preparing smoking articles. The treated tobacco materials are useful in various smoking article manufacturing processes. It can be used as tobacco laminae or cut filler or other smoking article materials in the manufacture of cigarettes or other smoking articles.

Alternatively, as described above, if the tobacco materials in the blend are cigarette side-products, the treated tobacco materials can be ground and used as a component in top dressing, or casing, or in any convenient mode selected by the manufacturer. In this case, in a typical cigarette having about 0.6 to about 1 g of cut filler per rod of smoking material, about 1% to about 5% of the treated material can advantageously be used as a top dressing or casing.

The present invention is more fully illustrated by the following examples, which are set forth to illustrate the present invention and are not to be construed as limiting thereof. In the following examples, mg means milligram, μg means micrograms, g means grams, L means liters, ml means milliliters, min means minutes, and mm means millimeters.

EXAMPLE 1

Natural burley tobacco laminate and natural flue cured tobacco laminae were mixed in ratios of 75:25, 50:50, or 25:75 by weight to form blends of burley:flue cured tobacco. The moisture content in the blends were adjusted to 20%, 30%, or 40%. A first group of blends was immediately subjected to heat treatment in a Sargent tray drier at a temperature of 230° F., 275° F. or 310° F. for 10 minutes. A second group of blends was stored for 12 hours after moisture adjustment and then subjected to the same heat treatment. A third group of blends was stored for 24 hours and then subjected to the same heat treatment.

The treated tobacco blends were then subjected to headspace analysis at 70° C. In each case a sample having a size of 3 gram was heated to 70° C. while an inert gas was swept through the sample. The inert gas containing volatiles extracted from the sample passed to a GC-mass spectrometer and the content of Maillard Reaction products, i.e., sugar thermal degradation products, was determined by measuring the total content of furfural and 5-methylfurfural. The results, measured in μg/g are reported in Table 1 below as "Maillard Yield". The pyrazine content was determined by measuring the total content of volatile pyrazines. These results in μg/g, measured using the same headspace analysis procedure, are reported in Table 1, below as "Pyrazine Yield".

TABLE 1

| Storage Time, Hours | Temperature ° F. | Flue Cured To Burley Ratio | Percent Moisture | Pyrazine Yield | Maillard Yield |
|---|---|---|---|---|---|
| 0 | 230 | 75:25 | 20 | 0.18 | 0.18 |
| 0 | 230 | 75:25 | 40 | 0 | 0 |
| 0 | 230 | 25:75 | 20 | 0 | 0 |
| 0 | 230 | 25:75 | 40 | 0.46 | 0 |
| 0 | 275 | 75:25 | 30 | 0.61 | 1.22 |
| 0 | 275 | 50:50 | 30 | 0.14 | 0.88 |
| 0 | 275 | 50:50 | 40 | 0.24 | 0.54 |
| 0 | 275 | 25:75 | 30 | 0 | 0.34 |
| 0 | 310 | 75:25 | 20 | 1.22 | 4.24 |
| 0 | 310 | 75:25 | 40 | 2.33 | 3.09 |
| 0 | 310 | 25:75 | 20 | 2.74 | 1.25 |
| 0 | 310 | 25:75 | 40 | 3.05 | 1.18 |
| 12 | 230 | 75:25 | 40 | 0 | 0 |
| 12 | 230 | 50:50 | 30 | 0 | 0 |
| 12 | 230 | 25:75 | 20 | 0 | 0 |
| 12 | 230 | 25:75 | 40 | 0 | 0 |
| 12 | 275 | 75:25 | 40 | 0.92 | 0.92 |
| 12 | 275 | 50:50 | 20 | 1.16 | 0.6 |
| 12 | 275 | 50:50 | 30 | 0.608 | 0.528 |
| 12 | 275 | 50:50 | 40 | 0.93 | 0.47 |
| 12 | 275 | 25:75 | 30 | 123 | 0.23 |
| 12 | 310 | 75:25 | 40 | 2.37 | 1.55 |
| 12 | 310 | 50:50 | 30 | 1.21 | 1.47 |
| 12 | 310 | 50:50 | 20 | 1.4 | 0.74 |
| 12 | 310 | 25:75 | 40 | 1.86 | 0.52 |
| 24 | 230 | 75:25 | 20 | 0 | 0 |
| 24 | 230 | 75:25 | 40 | 0 | 0 |
| 24 | 230 | 25:75 | 20 | 0 | 0 |
| 24 | 230 | 25:75 | 40 | 0 | 0 |
| 24 | 275 | 75:25 | 30 | 0.11 | 0.61 |
| 24 | 275 | 50:50 | 30 | 0.28 | 0.43 |
| 24 | 275 | 50:50 | 40 | 0.15 | 0.35 |
| 24 | 275 | 25:75 | 30 | 0.45 | 0.24 |
| 24 | 310 | 75:25 | 20 | 1.75 | 2.98 |
| 24 | 310 | ,75:25 | 40 | 1.9 | 1,97 |
| 24 | 310 | 25:75 | 20 | 0.92 | 0.6 |
| 24 | 310 | 25:75 | 40 | 2.26 | 0.97 |

As can be seen from Table 1 above, the yield of flavorant materials, i.e., pyrazines and Maillard n products was significant at the higher temperature ranges (275° F. and 310° F.). Pyrazine yields to be somewhat higher in blends having higher content, and when the moisture content was ed. Increasing storage time after moisture adjustment tended to decrease pyrazine yields. Maillard reaction product yields were higher in blends a higher flue cured tobacco content and when the moisture content was increased. Increased storage time tended to harm Maillard yields. Maximum flavorant yield, i.e., pyrazines plus Maillard products was achieved with the blends having a 75:25 flue cured to burley ratio.

In the specification and examples, there have been disclosed preferred embodiments of the invention. Although specific terms are employed in these examples, they are used in a generic and descriptive sense only and not for the purpose of limitation, the scope of the invention being defined by the following claims.

That which is claimed:

1. A method for providing flavorful and aromatic substances in tobacco, comprising the steps of:

contacting a first tobacco material with a second tobacco material to form a tobacco blend, said first tobacco material having a higher content of nitrogen source and a lower content of sugar source than said second tobacco material;

increasing the moisture content in said first and second materials of said tobacco blend to at least about 15%; and heating the tobacco blend having an increased moisture content to temperature of at least about 250° F. in a substantially atmospheric environment without a sealed pressure vessel for a time sufficient to generate flavorful and aromatic substances in said tobacco blend.

2. The method of claim 1, wherein said tobacco blend having an increased moisture content is substantially free of unabsorbed liquid.

3. The method of claim 1, wherein said tobacco blend having an increased moisture content is substantially free of exogenous sugar.

4. The method of claim 1, wherein the nitrogen source content in said first tobacco material is at least 10% higher than the nitrogen source content in said second tobacco material, and the sugar source content in said second tobacco material is at least 10% higher than the sugar source content in said first tobacco material.

5. The method of claim 1, wherein said first tobacco material primarily comprises burley tobacco.

6. The method of claim 1, wherein said second tobacco material primarily comprises flue cured tobacco.

7. The method of claim 1, wherein said second tobacco comprises Turkish tobacco.

8. The method of claim 1, wherein said blend has a moisture content of from about 20% to about 40%.

9. The method of claim 1, wherein said step of increasing the moisture content comprises contacting said tobacco blend with a composition consisting essentially of water.

10. The method of claim 1, wherein said heat treatment is at a temperature of from about 260° F. to about 325° F.

11. The method of claim 1, wherein said first tobacco material and said second tobacco material consist essentially of tobacco laminae.

12. The method of claim 1, wherein said first tobacco material and said second tobacco material are tobacco cut filler.

13. The method of claim 1, wherein said heating step is conducted under conditions sufficient to reduce the moisture content of said tobacco blend to below about 8% by weight.

14. The method of claim 5, wherein said burley tobacco has at least about 0.2% of $NH_4^+$.

15. The method of claim 6, wherein said flue cured tobacco has a sugar source content of at least about 10%.

16. A method for providing flavorful and aromatic substances, comprising the steps of:

contacting a burley tobacco material with a flue cured tobacco material to form a tobacco blend;

increasing the moisture content in the tobacco blend to an amount in the range of about 20% to about 40%, while maintaining said blend substantially free of exogenous sugar and substantially free of unabsorbed liquid; and heating the tobacco blend having an increased moisture content to a temperature of about 250° F. to about 350° F. in a substantially atmospheric environment without a sealed pressure vessel for a time sufficient to generate flavorful and aromatic substances in said tobacco blend.

17. The method of claim 16, wherein said step of increasing the moisture content comprises contacting said tobacco blend with a composition consisting essentially water.

18. The method of claim 16, wherein said heat treatment is conducted at a temperature of from about 260° F. to about 325° F.

19. The method of claim 16, wherein said first tobacco material and said second tobacco material consist essentially of tobacco laminae.

20. The method of claim 16, wherein said first tobacco material and said second tobacco material consist essentially of tobacco cut filler.

21. The method of claim 16, wherein the ratio of flue cured to burley tobacco in said blend is greater than about 50:50.

22. The method of claim 16, wherein the ratio of flue cured to burley tobacco in said blend is about 75:25.

23. The method of claim 16, wherein the heating step is conducted under conditions sufficient to reduce the moisture content of said tobacco blend to about 6%.

24. A method for providing flavorful and aromatic substances in tobacco, comprising the steps of:

providing a blend of a first tobacco material and a second tobacco material, the blend having a moisture content of at least about 20%, wherein the nitrogen source content of the first tobacco material is at least about 20% higher than the nitrogen source content of the second tobacco material, and the sugar source content of the second tobacco material is at least about 20% higher than the sugar source content of the first tobacco material;

heating the tobacco blend at a temperature of at least about 250° F. in a substantially atmospheric environment without a sealed pressure vessel for a time sufficient to generate flavorful and aromatic substances in the tobacco blend.

25. The method of claim 24, wherein the tobacco blend is substantially free of exogenous sugar.

26. The method of claim 24, wherein the tobacco blend is substantially free of unabsorbed liquid.

27. The method of claim 24, wherein the nitrogen source content of the first tobacco material is at least about 50% higher than the nitrogen source content of the second tobacco material, and the sugar source content of the second tobacco material is at least about 50% higher than the sugar source content of the first tobacco material.

28. The method of claim 24, wherein the first tobacco material comprises burley tobacco and the second tobacco material comprises flue cured tobacco.

29. The method of claim 24, wherein the heat treatment temperature is about 260° F. to about 325° F.

30. The method of claim 24, wherein the heating step is conducted under conditions sufficient to reduce the moisture content of the tobacco blend to below about 8% by weight.

* * * * *